US006842943B2

(12) United States Patent
Hoffmann et al.

(10) Patent No.: US 6,842,943 B2
(45) Date of Patent: Jan. 18, 2005

(54) PRESSURE-BALL SLIDING DOORSTOP

(75) Inventors: Peter Hoffmann, Overath (DE); Gundolf Heinrichs, Remscheid (DE); Ralf Duning, Solingen (DE)

(73) Assignee: Edscha AG, Remscheid (DE)

( * ) Notice: Subject to any disclaimer, the term of this patent is extended or adjusted under 35 U.S.C. 154(b) by 61 days.

(21) Appl. No.: 10/258,897

(22) PCT Filed: May 17, 2001

(86) PCT No.: PCT/DE01/01896

§ 371 (c)(1),
(2), (4) Date: Oct. 30, 2002

(87) PCT Pub. No.: WO01/90518

PCT Pub. Date: Nov. 29, 2001

(65) Prior Publication Data

US 2003/0051312 A1 Mar. 20, 2003

(30) Foreign Application Priority Data

May 20, 2000 (DE) ..... 100 25 185

(51) Int. Cl.[7] ..... E05F 3/20
(52) U.S. Cl. ..... 16/82; 16/50; 292/DIG. 15
(58) Field of Search ..... 16/85, 85 C, 86 R, 16/86 A, 86 C, 49, 54, 61, 70, DIG. 10, DIG. 17, DIG. 21; 292/262, 267, DIG. 15, DIG. 17; 296/146.11, 146.12; 267/196, 199, 248, 249

(56) References Cited

U.S. PATENT DOCUMENTS

| | | | | | |
|---|---|---|---|---|---|
| 4,194,265 | A | | 3/1980 | Zimmermann | 16/82 |
| 5,152,030 | A | * | 10/1992 | Cogo | 16/86 C |
| 5,173,991 | A | | 12/1992 | Carswell | 16/86 |
| 5,426,820 | A | * | 6/1995 | Coleman et al. | 16/85 |
| 5,452,501 | A | * | 9/1995 | Kramer et al. | 29/11 |
| 5,468,042 | A | * | 11/1995 | Heinrichs et al. | 296/146.4 |
| 5,761,766 | A | * | 6/1998 | Basham | 16/85 |
| 5,862,570 | A | | 1/1999 | Lezuch et al. | 16/82 |
| 6,065,185 | A | * | 5/2000 | Breed et al. | 16/86 C |
| 6,237,190 | B1 | * | 5/2001 | Grumm et al. | 16/82 |
| 6,370,733 | B2 | * | 4/2002 | Paton et al. | 16/86 C |
| 6,446,305 | B1 | * | 9/2002 | Kneeland | 16/82 |
| 6,584,642 | B2 | * | 7/2003 | Hodson | 16/85 |
| 6,687,953 | B1 | * | 2/2004 | Liang | 16/86 C |

FOREIGN PATENT DOCUMENTS

| | | | |
|---|---|---|---|
| DE | 2800256 | | 7/1979 |
| DE | 3122324 | A1 * | 12/1982 |
| DE | 8536427.4 | | 3/1986 |

(List continued on next page.)

*Primary Examiner*—Robert J. Sandy
*Assistant Examiner*—Andre' L. Jackson
(74) *Attorney, Agent, or Firm*—Davidson, Davidson & Kappel, LLC

(57) ABSTRACT

A doorstop that includes a retainer piece disposed on one of a door and a door support, the retainer piece including a plastic housing with a main opening and a guide opening arranged perpendicular to the main opening and parallel to a pivot axis of the door. The doorstop also includes a door retaining rod articulated on the other of the door and the door support. The door retaining rod passes through the main opening of the retainer piece housing and includes a brake ramp and a catch depression on a side of the door retaining rod. The doorstop also includes a catch device configured to determine specific door opening positions. The catch device includes a brake body and a spring. The catch device connects the retainer piece and the door retaining rod to each other in a moveable manner. The brake body includes a hollow cylinder having a semi-spherical closed end and an open end and is slidingly disposed in the guide opening of the retainer piece. The open end accommodates the spring so that the closed end is pre-tensioned by the spring relative to the brake ramp and catch depression and is guided in the guide opening free of tilt.

30 Claims, 3 Drawing Sheets

FOREIGN PATENT DOCUMENTS

| | | | |
|---|---|---|---|
| DE | 4325555 | | 2/1995 |
| DE | 19632101 | | 2/1998 |
| DE | 19632630 | | 2/1998 |
| DE | 29800314 | | 6/1999 |
| EP | 0643185 | | 3/1995 |
| EP | 0643185 | | 1/1997 |
| EP | 0816612 | | 1/1998 |
| EP | 0816612 | | 9/1999 |
| EP | 0824176 | | 6/2003 |
| FR | 2632902 | A1 * | 12/1989 |
| GB | 1160063 | | 7/1969 |
| WO | 9935358 | | 7/1999 |

* cited by examiner

PRESSURE-BALL SLIDING DOORSTOP

BACKGROUND OF THE INVENTION

The present invention relates to generally to a doorstop, and particularly to a door stop for a motor vehicle.

Such doorstops are known in the state of the art, having pivotally mounted brake and/or stop bodies in the form of catch rollers, roller-shaped elements or balls, for example. Thus the publication EP 0 643 185 A1 discloses a doorstop having a catch roller as brake and/or stop body and a ball as abutment on the other side. EP 0 816 612 A1 describes a doorstop having axially supported races as brake and/or stop bodies. DE 43 25 555 A describes such a doorstop having a brake and/or stop body in the form of a roller. All doorstops have separate bearing and/or retaining elements for the rolling brake and/or stop bodies. Such doorstops are also known, in which the brake and/or stop bodies are designed not as rolling components but as sliding bodies, which are guided in the housing by means of a separate guide piece.

SUMMARY OF THE INVENTION

The need to provide separate bearing and/or retaining elements and the need for guide pieces extends the chains of tolerances of the interacting functional parts and increases the overall dimensions of the doorstops. The construction and function moreover becomes complex and expensive.

An underlying technical object of the present invention is to design a doorstop of the type described above having small overall dimensions and weight and capable of flexibly absorbing high fixing forces and stop moments within tight dimensional tolerances with the least possible contact pressure per unit area between door retaining rod and brake bodies (also referred to as stop bodies).

The present invention provides a doorstop that includes a retainer piece disposed on one of a door and a door support. The retainer piece includes a plastic housing with a main opening and a guide opening arranged perpendicular to the main opening and parallel to a pivot axis of the door. The doorstop also includes a door retaining rod articulated on the other of the door and the door support. The door retaining rod passes through the main opening of the retainer piece housing and including a brake ramp and a catch depression on a side of the door retaining rod. The doorstop also includes a catch device configured to determine specific door opening positions. The catch device connects the retainer piece and the door retaining rod to each other in a moveable manner and includes a brake body and a spring. The brake body includes a hollow cylinder having a semi-spherical closed end and an open end and is slidingly disposed in the guide opening of the retainer piece. The open end accommodates the spring so that the closed end is pre-tensioned by the spring relative to the brake ramp and catch depression and is guided in the guide opening free of tilt.

The doorstop according to the invention is light and compact and flexibly absorbs high stop moments within small tolerances and advantageously allows the door retaining rod to swivel out perpendicular to its clamping direction due to the brake and/or stop bodies acting in opposition, without tilting the point of contact in the process. The cylindrical part of the brake and/or stop body, in which the spring is accommodated, has a length which advantageously permits guiding without tilting.

In one embodiment having a truncated dome head, the point of contact between brake and/or stop body and door retaining rod is advantageously enlarged in such a way that it consists not just of a point or, in the case of a groove with complementary profile, not just of a contact line, but of a contact area. By enlarging the bearing surface, the contact pressure per unit area is correspondingly reduced for the same stop forces, so that the brake and/or stop bodies may advantageously be made of plastic.

If the pressure spring in opposition to the metal frame is supported on the end face of the housing, the relaxation occurring in the case of plastic and hence any resulting play between the functional elements is thereby advantageously avoided.

One embodiment in which the door retaining rod has a plastic-covered metal core allows high stop forces to be absorbed and advantageously avoids the generation of loud noise. Forming the brake ramps and the catch depressions through or between local thickenings of the plastic covering on the metal core represents a simple way of arranging them on the sides of the door retaining rod facing the pivot axis.

The arrangement of a continuous longitudinal groove with a complementary profile to the cap through brake ramps and catch depressions forms a precise lateral guide for the brake and/or stop bodies over the entire length, without increasing the contact pressure per unit area.

The integral design of an abutment or limit stop on the door retaining rod corresponding to the open position of the door advantageously permits a precise construction, in which additional toleranced components can be dispensed with. Swiveling the door and the resulting longitudinal displacement of the door retaining rod in relation to the housing of the retainer piece lead to a swivel movement of the door retaining rod about its pivot axis. An embodiment, in which the walls of the opening arranged perpendicular to the guide openings have arches over the width of the opening, which guide the door retaining rod laterally and the convexly rounded dome heads of which are arranged on a level with the center axis of the guide openings and align with their inner wall, advantageously allows the door retaining rod to swivel out.

An embodiment in which the bearing eye is extended by forming the metal core parallel to the pivot axis advantageously allows very high stop forces to be absorbed. If the opening is dimensioned so that the door retaining rod can be introduced with its end having the bearing eye foremost, this advantageously means that the door retaining rod can have an integral abutment at the other end without this impeding assembly.

Designing the closing cap of the brake and/or stop body with approximately equal wall thicknesses advantageously allows the brake and/or stop bodies to be efficiently manufactured from plastic by the injection molding process whilst ensuring high strength and stability. Designing the outer surface of the cylindrical part of the brake and/or stop bodies with channels running in the direction of movement permits a favorable distribution of slide lubricants and reduction of the contact surface and hence the frictional resistance between brake and/or stop body and inner surface of the guide opening, without adversely affecting the precise and tilt-free guiding of the brake and/or stop bodies in the cylindrical guide opening.

The provision of underside fixing apertures in the metal frames for fixing the doorstop to a door assembly piece advantageously permits an alternative design with internal thread or with press-in screws affording a highly flexible variation of the hole piercing.

The integral arrangement of cushions of elastic material on the upper end surface of the housing reduces the overall dimensions and allows the doorstop to be designed using fewer parts.

DESCRIPTION OF THE DRAWINGS

The aforementioned and other advantages of the invention will be explained in the description of exemplary embodiments, which are represented in the drawing attached, in which.

DETAILED DESCRIPTION

Figure 1:
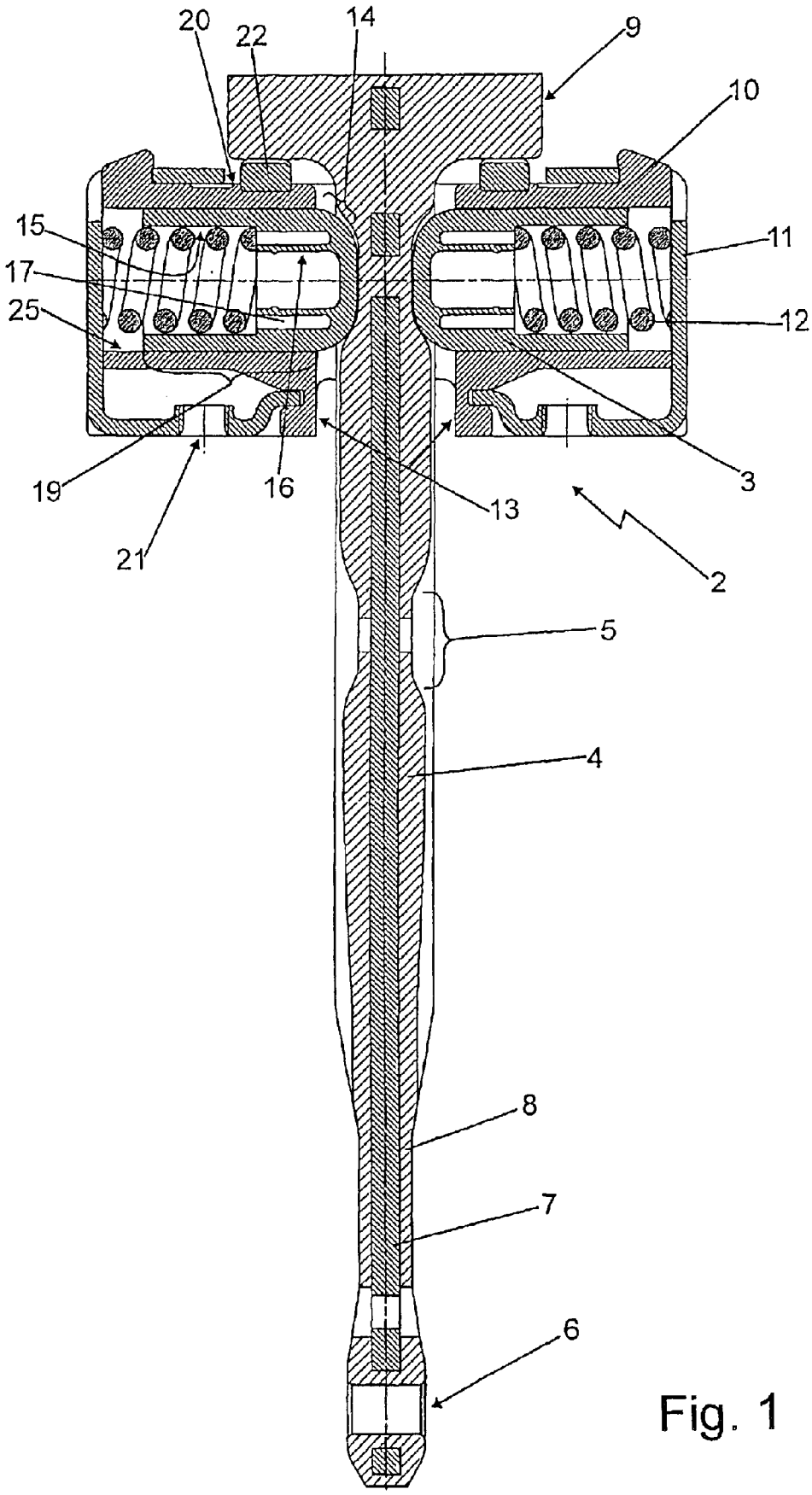
FIG. 1 shows the doorstop in a sectional side view parallel to the pivot axis with door retaining rod passing through the retainer piece.

FIG. 1 shows a sectional side view of a doorstop according to the invention, the plane of section running through the doorstop parallel to the pivot axis and the door retaining rod 1 passing though the retaining piece 2. At its bottom end in the figure, the door retaining rod 1 has a bearing eye 6 and at the other end an abutment 9. The door retaining rod 1 is constructed from a metal core 7, for example a flat steel section, which is covered with plastic. The plastic covering 8 is applied with different thicknesses over the length and forms bulges in the form of local thickenings, which form the brake ramps 4 and the catch depressions 5 between the bulges. In the exemplary embodiment shown, the abutment 9, which forms the limit stop corresponding to the open position of the door, is of integral T-shaped design. The abutment 9 or the limit stop may also be alternatively formed by a pin, which is arranged through a corresponding opening in the door retaining rod 1 in the direction of the pivot axis. The brake ramps 4 and the catch depressions 5 are formed on the sides of the door retaining rod facing the pivot axis. In the position shown the brake and/or stop bodies 3 bear bilaterally preloaded against catch depressions. The door retaining rod 1 is led through the opening 13 in the housing 10. The brake and/or stop bodies 3 are guided in guide openings 25 arranged perpendicular to the opening 13.

The brake and/or stop bodies 3 take the form of hollow cylinders, which are sealed at one end by a semi-spherical cap 14. In their open end they accommodate a pressure spring 12 resting on the closing cap 14, the spring being supported on a side wall of the housing 10. The end faces of the housing 10 are enclosed by U-shaped metal frames 11, which also constitute the supporting wall for the pressure springs. The brake and/or stop bodies 3 have a central bore 16 accessible from their cylindrical cavity 15 and further bores 17 arranged in a circle around this. The shape and arrangement of the bores 16 and 17 permit approximately equal wall thicknesses in the semi-spherical cap 14. The semi-spherical cap 14 is truncated at its front end. The approximately equal wall thicknesses provide an advantageous prerequisite for manufacturing the brake and/or stop bodies from plastic by the injection molding process. In its cylindrical part 19 the outer wall of the brake and/or stop bodies 3 is fluted in the direction of movement, thereby on the one hand ensuring a favorable distribution and transmission of slide lubricants and on the other reducing the bearing surface of the cylindrical part 19 on the inner surface of the guide opening 25 and hence frictional forces occurring when the brake and/or stop bodies 3 slide in the guide opening 25.

Cushions 22 of an elastic material are integrated into the upper end surface 20 of the housing 10, against which cushions the abutment 9 resiliently strikes when the door is in the open position. Fixing apertures 21 are arranged in the bottom end surfaces of the metal frames 11. In the exemplary embodiment shown these have an internal thread for fixing the retainer piece to a door assembly piece by means of threaded screws. Press-on screws, not shown here, can also be used for fixing, however. It will be obvious that in the embodiment of the housing 10 and metal frame 11 shown there is a high degree of flexibility in the choice of hole spacing and hence in the hole piercing variants.

Figure 2:
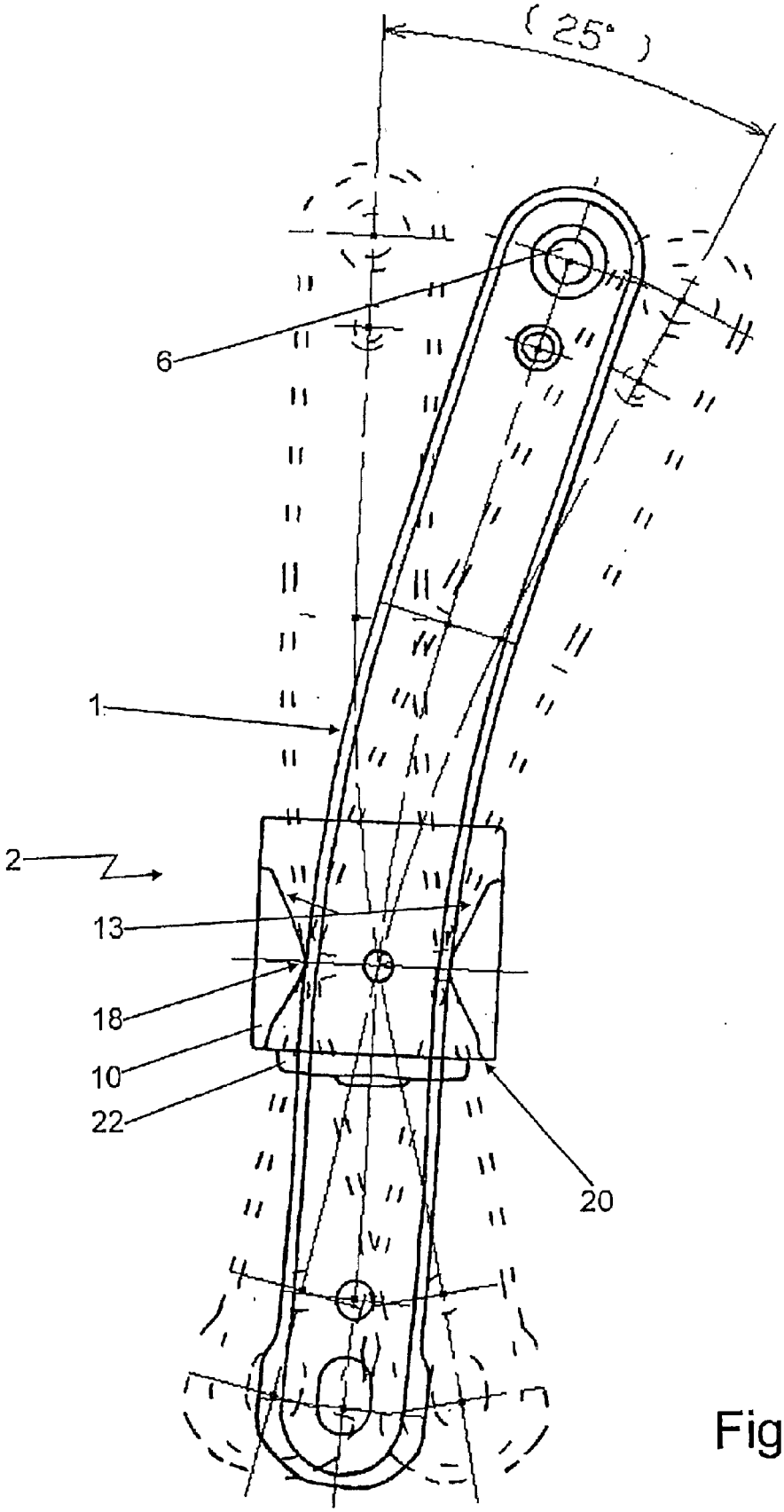
FIG. 2 shows a diagram of the doorstop in a side view perpendicular to the plane of FIG. 1

FIG. 2 shows a doorstop having a door retaining rod 1 that differs from the exemplary embodiment in FIG. 1, the plane of the figure being perpendicular to that in FIG. 1. The door retaining rod 1 passes through the housing 10 and is inserted through the opening 13 in the housing 10. At the same time it is laterally guided by the arches 18 on their convexly rounded dome heads. The shape and dimensions of the opening 13 allow the door retaining rod to swivel perpendicular to the pivot axis. A central swivel position of the door retaining rod 1 is represented by unbroken lines, while the dashed lines on either side thereof represent the extreme swivel positions of the door retaining rod 1 to both sides. In this embodiment the swivel range is designed to be approximately ±12.50°, that is a total of approximately 25°.

In this representation the stop cushions 22 can be seen integrated into the upper end surface 20 of the housing 10. The circle indicated at the point of intersection of the three centerlines of the door retaining rods 1 corresponds approximately to the bearing surface of the truncated caps of the brake and/or stop bodies 3 on the sides of the door retaining rod 1 having the brake ramps 4 and catch depressions 5. Since they are situated on a level with the opposing dome heads of the arches 18, this point of intersection also represents the swivel axis of the door retaining rod 1 for its swivel movements perpendicular to the pivot axis.

Figure 3:
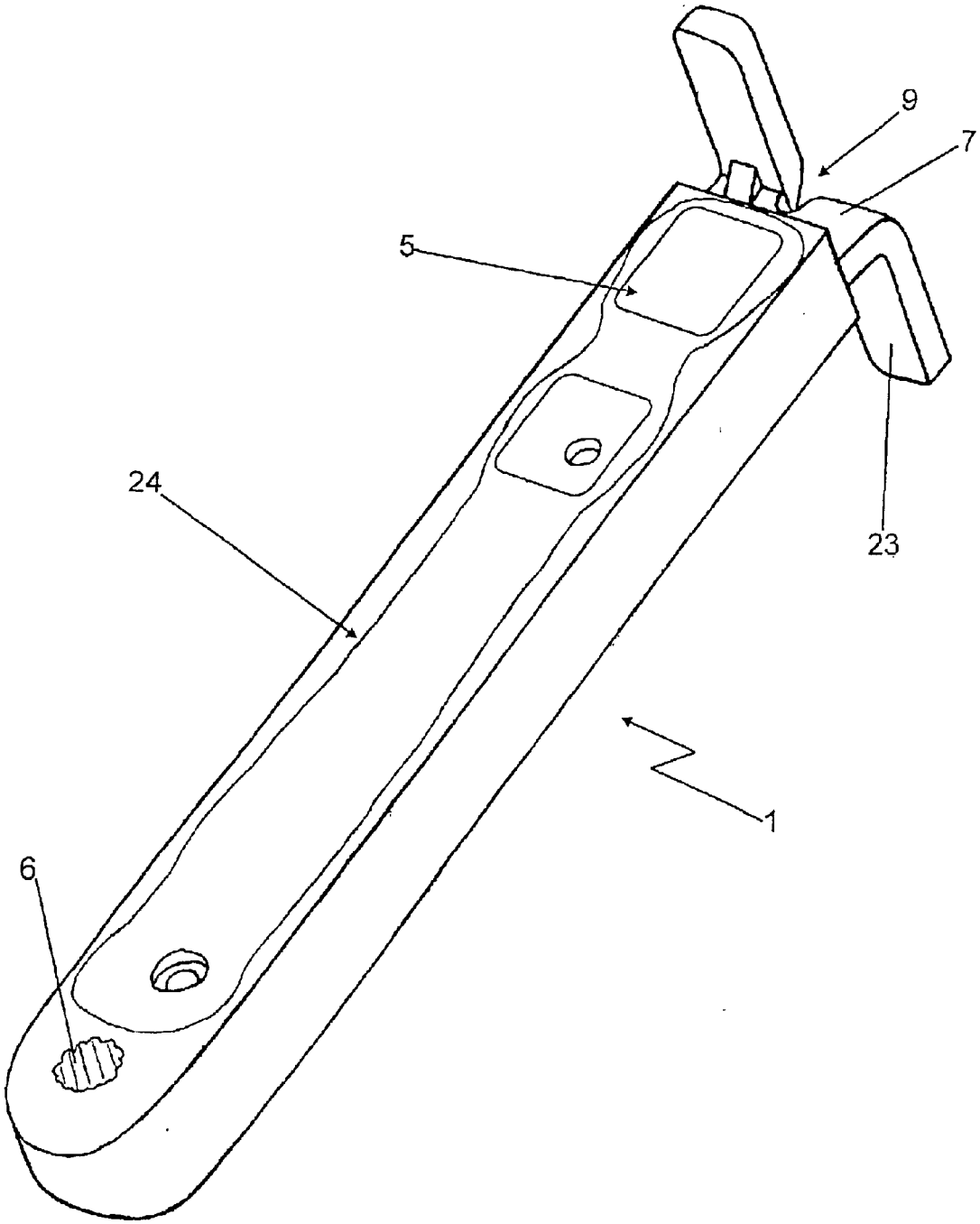
FIG. 3 shows a perspective view of the door retaining rod.

FIG. 3 shows a perspective view of a door retaining rod 1. The bearing eye 6, with which the door retaining rod 1 is pivoted on a door assembly piece, is arranged at the bottom end of the rod as shown in the figure. The abutment 9, which is here integrally formed by right-angled deflection of the two lateral halves 23 of the centrally divided metal core 7, is shown at the other end of the door retaining rod 1. A guide groove 24, the profile of which is designed to complement the apex of the truncated semi-spherical closing cap 14 of the brake and/or stop body 3, runs in the longitudinal direction of the door retaining rod 1 over the catch depressions 5 and the brake ramps 4.

What is claimed is:

1. A doorstop, comprising:

a retainer piece disposed on one of a door and a door support and including a plastic housing with a main opening and a guide opening arranged perpendicular to the main opening and parallel to a pivot axis of the door;

a door retaining rod articulated on the other of the door and the door support, the door retaining rod passing through the main opening of the retainer piece housing and including a brake ramp and a catch depression on a side of the door retaining rod; and a catch device configured to determine specific door opening positions and including a brake body and a spring, the catch device connecting the retainer piece and the door retaining rod to each other in a moveable manner, wherein the brake body includes a hollow cylinder having a semi-spherical closed end and an open end and is slidingly disposed in the guide opening of the retainer piece, the open end partially accommodating the spring therein so that the closed end is pre-tensioned by the spring relative to the brake ramp and catch depression and is guided in the guide opening free of tilt.

2. The doorstop as recited in claim 1, characterized in that the semi-spherical closed end of the brake body projects into the main opening and bears against the side of the door retaining rod having the brake ramp and catch depressions.

3. The doorstop as recited in claim 1, wherein the semi-spherical closed end of the brake body is a cap.

4. The doorstop as recited in claim 1 wherein the brake body includes plastic and the semi-spherical closed end of the brake body is truncated.

5. The doorstop as recited in claim 1 wherein the main opening has walls arranged perpendicular to an intersection to the guide opening, the walls including arches having convexly rounded dome heads arranged on a level with the guide opening for laterally guiding the door retaining rod perpendicular to the side having the catch depression.

6. The doorstop as recited in claim 1 wherein an outer surface of a cylindrical portion of the brake body is fluted in the direction of movement.

7. The doorstop as recited in claim 1, wherein a profile of the main opening is shaped to enable the door retaining rod to swivel by at least plus/minus 12.5° about an axis that that is perpendicular to the pivot axis and intersects an axis of the cylindrical brake body.

8. The doorstop as recited in claim 1, wherein the door is a motor vehicle door.

9. The doorstop as recited in claim 1 wherein the retainer piece further includes a second guide opening arranged perpendicular to the main opening and parallel to the pivot axis, and wherein the catch device further includes a second spring and a second brake body slidingly disposed in the second guide opening.

10. The doorstop as recited in claim 9, wherein the door retaining rod includes a second brake ramp and a second catch depression on a second side of the door retaining rod.

11. The doorstop as recited in claim 1, further comprising a U-shaped metal frame enclosing an end of the housing.

12. The doorstop as recited in claim 11 wherein the spring is supported against the metal frame.

13. The doorstop as recited in claim 11, further comprising a fixing aperture disposed in an underside of the metal frame.

14. The doorstop as recited in claim 11, further comprising upwardly projecting cushions of elastic material disposed integrally in an upper end surface of the housing between an end of the metal frame and the main opening.

15. The doorstop as recited in claim 1 wherein the door retaining rod includes a metal core covered with plastic and a bearing eye serving as a pivot at one end and an abutment serving as a limit stop at the other end, the limit stop defining an open position of the door.

16. The doorstop as recited in claim 15, wherein the brake ramp and the catch depression are arranged on the side of the door retaining rod facing the pivot axis and are formed by or between bulges of the plastic covering.

17. The doorstop as recited in claim 15, wherein the door retaining rod has a groove in the side having the brake ramp and catch depression, the groove running continuously in a longitudinal direction between the bearing eye and the abutment, a profile of the groove complementing the closed end of the brake body.

18. The doorstop as recited in claim 15, wherein the abutment is integrally formed with the door retaining rod.

19. The doorstop as recited in claim 15, wherein the metal core is centrally divided into two sides, and the abutment is formed by ends of the two sides bent at right-angles in opposite directions from one another.

20. The doorstop as recited in claim 15 wherein the bearing eye run parallel to the pivot axis and is raised relative to a surface of the door retaining rod by a forming out of a section of the metal core parallel to the pivot axis.

21. The doorstop as recited in claim 15 wherein the main opening is dimensioned so that the door retaining rod can be introduced with the end having the bearing eye foremost.

22. A doorstop, comprising:

a retainer piece disposed on one of a door and a door support and including a plastic housing with a main opening and a guide opening arranged perpendicular to the main opening and parallel to a pivot axis of the door;

a door retaining rod articulated on the other of the door and the door support, the door retaining rod passing through the main opening of the retainer piece housing and including a brake ramp and a catch depression on a side of the door retaining rod; and a catch device configured to determine specific door opening positions and including a brake body and a spring, the catch device connecting the retainer piece and the door retaining rod to each other in a moveable manner, wherein the brake body includes a hollow cylinder having a semi-spherical closed end and an open end and is slidingly disposed in the guide opening of the retainer piece, the open end accommodating the spring so that the closed end is pre-tensioned by the spring relative to the brake ramp and catch depression and is guided in the guide opening free of tilt, wherein the closed end of the brake body includes a central bore accessible from a cylindrical cavity inside the brake body and includes further bores arranged in a circle around the central bore.

23. A doorstop, comprising:

a door retaining rod pivotably articulated on one of a door and a door support, said door retaining rod having a course comprising at least one of a brake ramp and a catch depression on a first side of said door retaining rod;

a retainer housing disposed on the other of said door and said door support and including a main opening for receiving said door retaining rod and a first guide opening; and a first catch device disposed in said retainer housing and configured to resiliently engage said first side of said door retaining rod, said first catch device including a first spring and a first brake body, wherein said first brake body is slidingly disposed in said first guide opening and includes a hollow cylinder having a closed end and an open end, wherein said first spring urges said closed end towards said first side of said door retaining rod, and wherein said first spring is accommodated at least partially within said open end.

24. The doorstop as recited in claim 23, wherein said retainer housing is an injection molded plastic part.

25. The doorstop as recited in claim 23, wherein said first guide opening is arranged in said retainer housing substantially perpendicular to said door retaining rod, and wherein said first brake body is guided in said first guide opening free of tilt such that said first spring is compressed according to said course of said door retaining rod displacing said first brake body in said guide opening.

26. The doorstop as recited in claim 23 wherein said closed end is a cap having a truncated, semi spherical shape.

27. The doorstop as recited in claim 23, wherein said closed end includes, on a side facing away from said door retaining rod, internal walls defining a central bore and a plurality of further bores arranged in a circle around said central bore, wherein a diameter of said central bore is larger than a diameter of any of said further bores.

28. The doorstop as recited in claim 23, wherein said retainer housing comprises a second guide opening receiving a second catch device for engaging a second side of said door retaining rod, and wherein said first catch device and said second catch device protrude from said retainer housing in such a manner that said door retaining rod is kept at a distance from circumscribing edges of said main opening.

29. The doorstop as recited in claim 23, wherein said first side of said door retaining rod includes a guide groove centrally running along said door retaining rod, said guide groove being delimited by protruding lateral flanges.

30. The doorstop as recited in claim 29, wherein said guide groove has a profile perpendicular to said course and complimentary to said closed end.

* * * * *